US005983912A

United States Patent [19]

Leu

[11] Patent Number: 5,983,912

[45] Date of Patent: Nov. 16, 1999

[54] CRUTCH SUPPORT SHELF

[76] Inventor: James M. Leu, 4103 Hidden Meadows Dr., Arnold, Mo. 63010

[21] Appl. No.: 09/208,397

[22] Filed: Dec. 9, 1998

[51] Int. Cl.[6] ..... A61H 3/02; A47B 96/02

[52] U.S. Cl. ..... 135/66; 135/68; 108/42; 108/152

[58] Field of Search ..... 135/66, 68, 69, 135/74, 75; 108/150–152, 50.11, 50.14, 50.16, 6, 12, 18, 42

[56] References Cited

U.S. PATENT DOCUMENTS

| | | | |
|---|---|---|---|
| 751,942 | 2/1904 | Renno | 135/68 |
| 1,463,675 | 7/1923 | Coleman | 135/68 |
| 2,311,049 | 2/1943 | Hedden | 135/68 |
| 2,378,486 | 6/1945 | Jones | 135/68 |
| 2,423,635 | 7/1947 | Blum | 135/68 |
| 2,553,730 | 5/1951 | Taylor | 135/68 |
| 3,771,466 | 11/1973 | Ferdinand et al. | 108/152 X |
| 3,985,149 | 10/1976 | Cadman | 135/68 |
| 4,910,927 | 3/1990 | Beatty | 135/66 |
| 5,090,434 | 2/1992 | Hagen | 135/66 |

FOREIGN PATENT DOCUMENTS

| | | | |
|---|---|---|---|
| 125887 | 11/1947 | Australia . | |
| 1710049 | 2/1992 | U.S.S.R. | 135/66 |

*Primary Examiner*—Robert Canfield
*Attorney, Agent, or Firm*—Haverstock, Garrett & Roberts

[57] ABSTRACT

A support shelf adapted for attachment to a crutch, the crutch including a pair of spaced, opposed downwardly converging rods, the support shelf including a member having a generally flat top surface and a peripheral edge portion extending therearound, the member including a pair of grooves extending inwardly from the spaced oppositely facing portions of the peripheral edge, the grooves being adapted for cooperatively receiving the downwardly converging rods of the crutch for wedging the member between the rods to hold the member with the top surface thereof in a generally horizontal orientation when the rods are in a generally upstanding orientation, the member optionally being of two piece construction for clamping to the rods, and further optionally being of hinged construction for movement between a deployed position and a stored position.

5 Claims, 3 Drawing Sheets

CRUTCH SUPPORT SHELF

TECHNICAL FIELD

This invention relates generally to a crutch used as an aid for standing and walking by persons with injured or diseased lower body portions, and more particularly, to a shelf member for attachment to a crutch adapted for supporting a user's leg, briefcase, purse, package, or other item while standing and/or walking using the crutch.

BACKGROUND OF THE INVENTION

Often, crutch users experience discomfort, pain and fatigue when standing and/or walking using the crutch. Such discomfort and the like can be relieved by stopping and resting the affected body portion on a suitable surface located at the required elevation. Often, however, such surfaces suitable for resting are not available or convenient, such that the discomfort and pain is ongoing.

Additionally, crutch users often find it difficult to carry items such as a briefcase, purse, package and the like while using a crutch, as holding such items entails use of a hand normally needed for grasping a handle on the crutch.

Accordingly, the present invention is directed to overcoming one or more of the problems as set forth above.

DISCLOSURE OF THE INVENTION

In one aspect of the present invention, a support shelf adapted for attachment to a crutch is disclosed, the crutch including a pair of spaced, opposed downwardly converging rods, the support shelf including a member having a generally flat top surface and a peripheral edge portion extending therearound, the member including a pair of grooves therein extending inwardly from the spaced oppositely facing portions of the peripheral edge, the grooves being adapted for cooperatively receiving the downwardly converging rods of the crutch for wedging the member between the rods for holding the member with the top surface thereof in a generally horizontal orientation when the rods are in a generally upstanding orientation.

According to another aspect of the invention, the support shelf is of two piece construction, splitting the grooves to allow clamping the shelf to the crutch.

According to a further aspect of the invention, the top surface is located on a portion hingedly attached to a portion mounted to the crutch, so as to be deployable in a position angularly related to the crutch and stored generally parallel to the crutch.

Still further the top surface of the support can be provided with a cushioned pad for comfort.

BEST MODE FOR CARRYING OUT THE INVENTION

Figure 1:
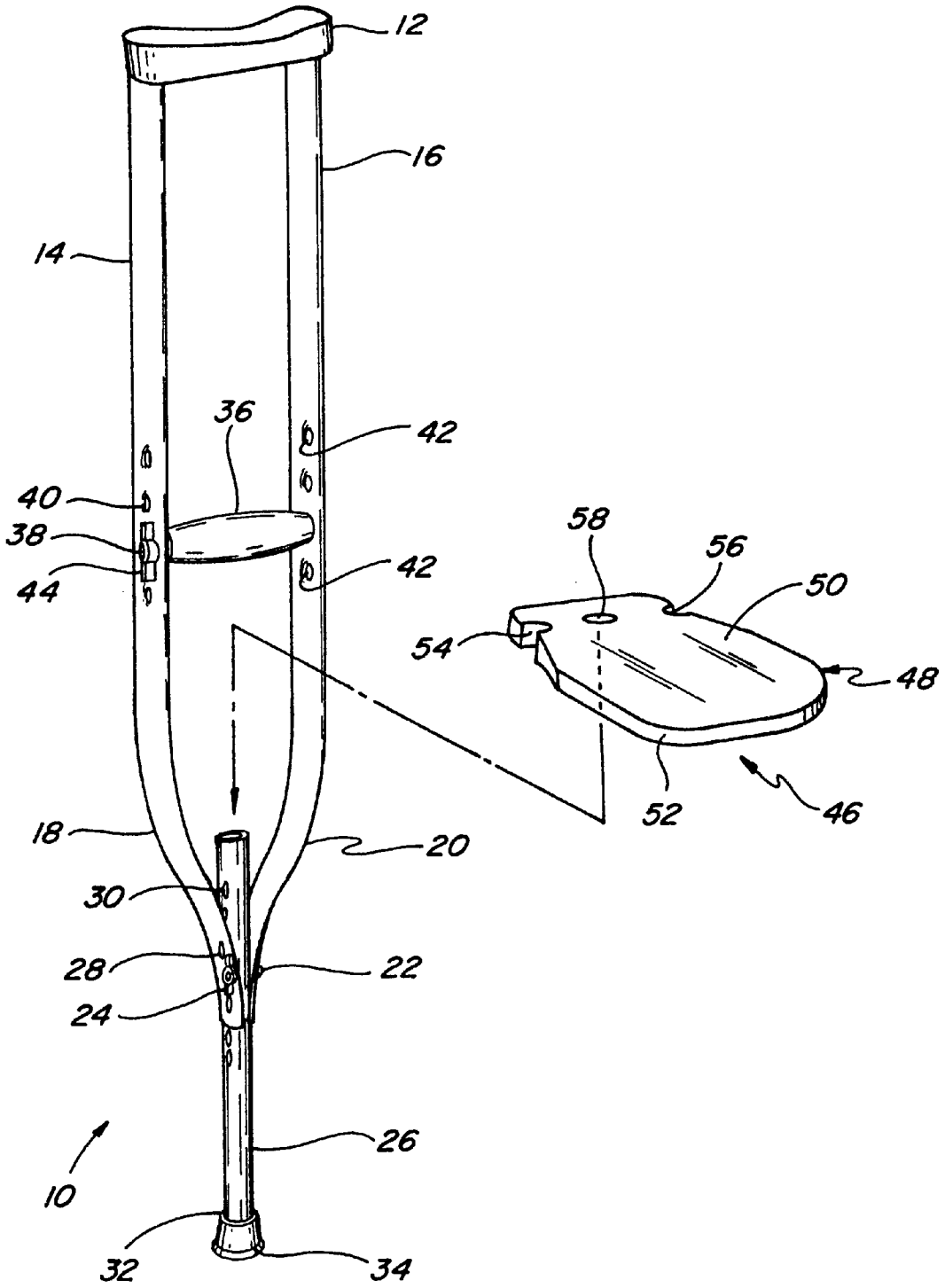
FIG. 1 is a perspective view of a support shelf according to the present invention shown in position for mounting to a conventional prior art crutch.

Referring to FIG. 1, a typical prior art crutch 10 is shown, crutch 10 generally including an upper most arm pad 12 having a pair of spaced rods 14 and 16 extending downwardly therefrom. Rods 14 and 16 include lowermost downwardly converging portions 18 and 20 joined together by a threaded bolt 22 and wing nut 24 about a centrally located lower support rod 26, downwardly converging portions 18 and 20 and support rod 26 having holes 28 and 30 respectively adapted for receiving bolt 22 to enable selectibly varying the height of crutch 10. Lower support rod 26 has a lowermost terminal end 32 covered with a resilient, slip resistant foot 34. A handle 36 extends between rods 14 and 16 at a location upwardly from downwardly converging portions 18 and 20 and is selectibly mountable to the rods using a threaded rod 38 which passes through handle 36 and any of a selected pair of opposing holes 40 and 42, rod 38 being securable in the holes with wing nuts 44. Here, it should be understood that rods 14, 16 and 26 can be constructed of any suitable conventional material, such as wood, aluminum and other metallic materials, and plastics materials.

Figure 1A:
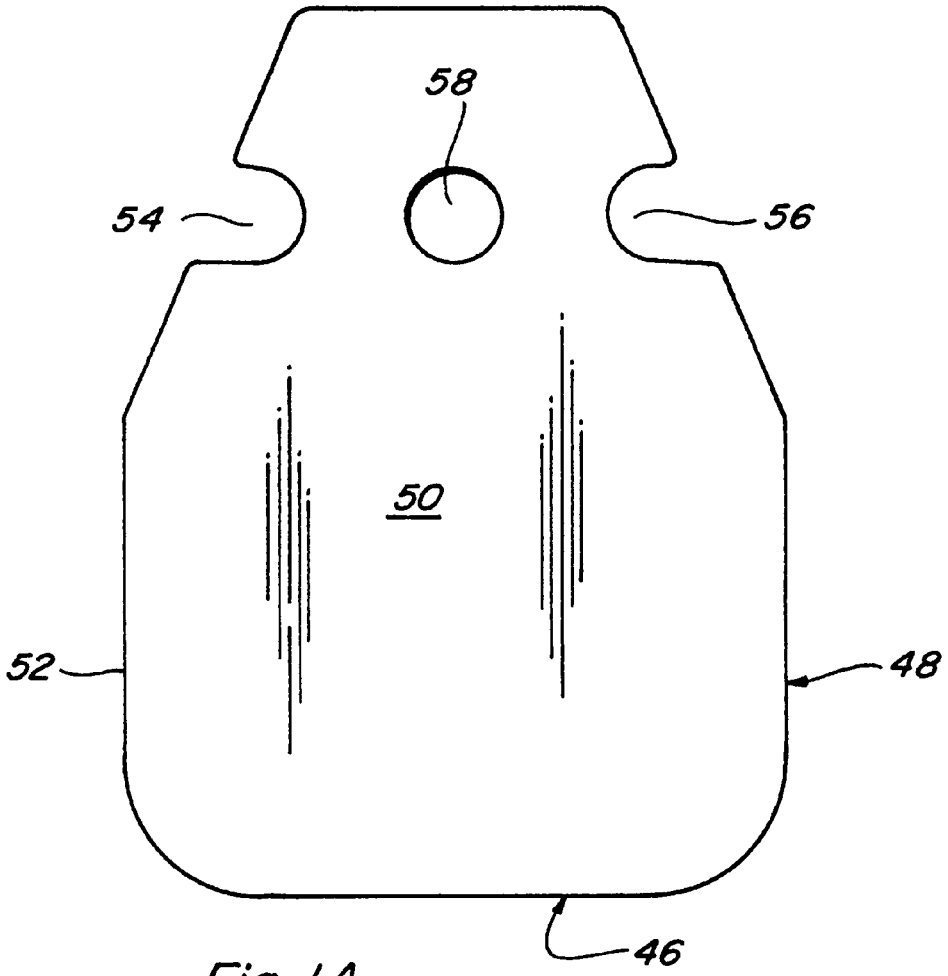
FIG. 1A is a top view of the support shelf of FIG. 1.
Figure 1B:
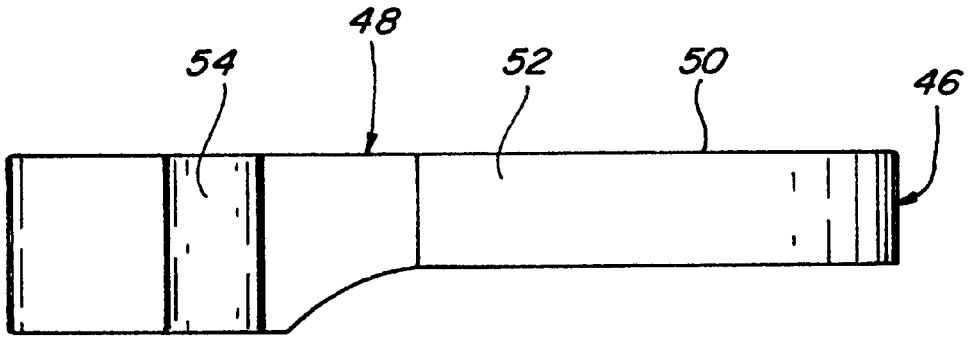
FIG. 1B is a side view of the support shelf of FIG. 1.

A support shelf 46 constructed and operable according to the present invention is shown ready for mounting to crutch 10 is a position spaced above terminal end 32 of the crutch for supporting the user's lower leg, briefcase, purse, a package, or other item. Referring also to FIG. 1A and 1B, support shelf 46 includes a generally planar member 48 having a substantially flat top surface 50 and an outer peripheral edge 52 extending therearound. Member 48 includes a pair of grooves 54 and 56 therein extending inwardly from spaced oppositely facing portions of the peripheral edge, the grooves being adapted for cooperatively receiving the downwardly converging portions 18 and 20, respectively, of rods 14 and 16 such that the portion of member 48 between grooves 54 and 56 is wedgedly engaged with downwardly converging portions 18 and 20 for positioning member 48 in a generally right angular relation to rods 14 and 16. Member 48 further includes a hole 58 therethrough adapted for receiving the upper portion of lower support rod 26 when mounted to crutch 10.

Figure 2:
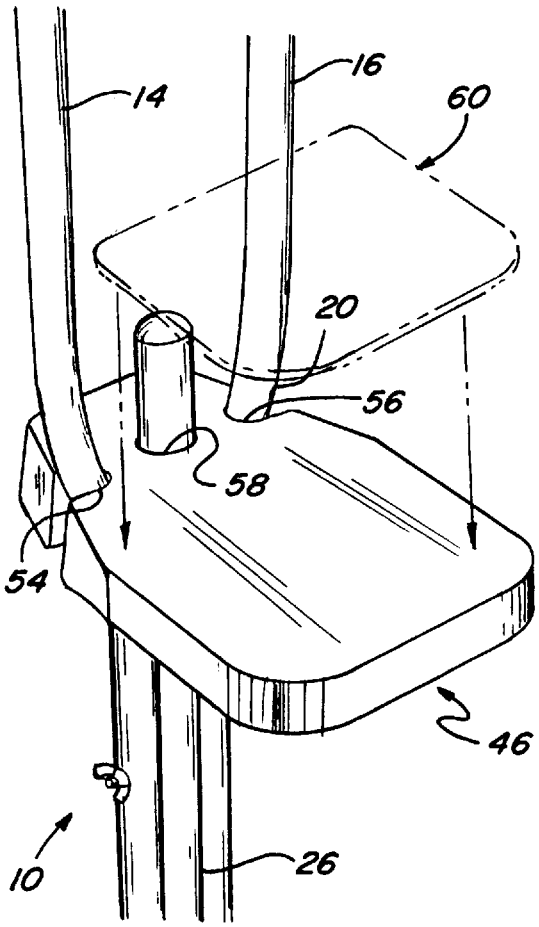
FIG. 2 is a perspective view of the crutch of FIG. 1 showing the support shelf according to the present invention mounted thereto and showing an optional pad positioned for placement on a top surface of the support shelf.

With reference to FIG. 2, support shelf 46 is shown mounted to crutch 10 with downwardly converging portions 18 and 20 of rods 14 and 16 cooperatively received in respective grooves 54 and 56 such that the portion of member 48 intermediate grooves 54 and 56 is wedged between converging portions 18 and 20 and the upper portion of lower support rod 26 is cooperatively received in hole 58 of member 48. Here, it should be understood that support shelf 46 can be mounted to crutch 10 so as to be located in position for a user to rest their leg thereon, or, oriented such that support shelf 46 extends outwardly away from the user, for supporting the user's briefcase, purse, package or the like. Additionally, a resilient, soft pad 60 is shown in position for placement on top surface 50 of support shelf 46 to provide cushioning for the user's leg.

Figure 3:
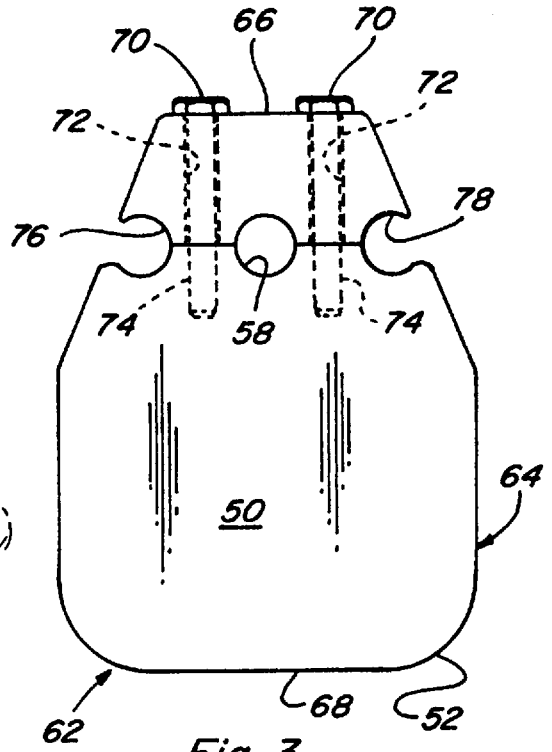
FIG. 3 is a top view of another embodiment of a support shelf according to the present invention for use with the crutch of FIG. 1.

Turning to FIG. 3, another embodiment 62 of a support shelf constructed and operable according to the teachings of the present invention is shown, like parts of support shelf 52 and support shelf 46 being identified by like numerals. Support shelf 62 includes a member 64 of two piece construction including a first portion 66 and a second portion 68 joined together with threaded bolts 70 which pass through holes 72 in first portion 66 and threadedly engage threaded holes 74 in second portion 68. First portion 66 and second portion 68 split a pair of opposed grooves 76 and 78 adapted for cooperatively receiving downwardly converging portions 18 and 20 of crutch 10 as explained above, for wedging a portion of member 64 intermediate grooves 76 and 78 between converging portions 18 and 20. Here, first portion 66 and second portion 68 of member 64 extend a greater distance around each of the grooves 76 and 78 such that bolts 70 must be loosened or removed to enlarge the grooves for cooperatively receiving downwardly converging portions 18 and 20, bolts 70 being then tightenable to clamp downwardly converging portion 18 and 20 in the grooves 76 and 78, respectively. Member 64 includes a generally flat top surface 50 and a hole 58 intermediate grooves 76 and 78 adapted for receiving the uppermost portion of lower support rod 26 as explained above.

Figure 4:
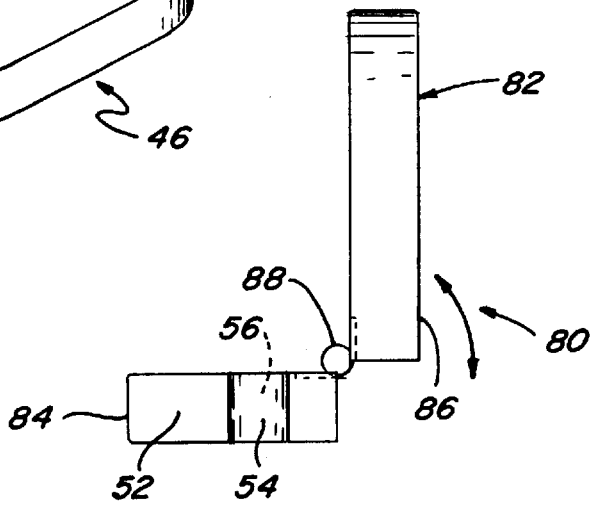
FIG. 4 is a side view of still another embodiment of a shelf according to the present invention for use with the crutch of FIG. 1.

FIG. 4 shows still another embodiment 80 of a support shelf constructed and operable according to the present invention, like parts of support shelf 80 and support shelves 46 and 62 being identified by like numbers. Support shelf 80 includes a generally planar member 82 of two piece construction including a first portion 84 and a second portion 86, portions 84 and 86 being hingedly connected by a hinge 88 to allow folding portion 86 relative to portion 84 as shown by the arrow. Portion 84 includes a peripheral edge 52 extending therearound including a pair of opposed grooves 54 and 56 extending inwardly therein and adapted for cooperatively receiving downwardly converging portion 18 and 20 of crutch 10 in the above described manner. Support shelf 80 can further include a hole 58 therethrough intermediate grooves 54 and 56 for receiving the upper portion of lower support rod 26 also in the above described manner. An important advantage of support shelf 80 is the ability to hingedly position portion 86 generally parallel to and between rods 14 and 16 when not in use, and positioning portion 86 and in angular relation to the rods when use is desired.

Thus, there has been shown and described a novel invention in a support shelf for a crutch which achieves many of the objects and advantages sought therefor. It will be apparent to those skilled in the art, however, that many changes, modifications, variations and other uses and applications for the subject support shelf are possible and all such changes, modifications, variations and other uses and applications which do not depart from the spirit and scope of the invention are deemed to be covered by the invention which is limited only by the claims which follow.

I claim:

1. A support shelf adapted for attachment to a crutch, the crutch including a pair of spaced, opposed downwardly converging rods, the support shelf comprising:

a member having a generally flat top surface and a peripheral edge portion extending therearound, the member including a pair of channel shaped grooves extending inwardly from spaced, oppositely facing portions of the peripheral edge, the grooves being adapted for cooperatively receiving the downwardly converging rods of the crutch for wedging the member between the rods to hold the member with the top surface thereof in a generally horizontal orientation when the rods are in a generally upstanding orientation, and wherein the member has a hole therethrough intermediate the grooves for cooperatively receiving a third rod of the crutch located intermediate the downwardly converging rods.

2. The support shelf, as set forth in claim 1, wherein the member comprises a first portion including the grooves therein and a second portion hingedly attached to the first portion.

3. The support shelf, as set forth in claim 1, further comprising at least one generally flat pad on the top surface of the member.

4. The support shelf, as set forth in claim 1, wherein the member is made of a plastics material.

5. The support shelf, as set forth in claim 1, wherein the member is made of a metallic material.

* * * * *